US008734098B2

(12) United States Patent
Ortiz et al.

(10) Patent No.: US 8,734,098 B2
(45) Date of Patent: May 27, 2014

(54) BOOSTER PUMP SYSTEM FOR POOL APPLICATIONS

(71) Applicants: Gary Ortiz, Clemmons, NC (US); Jason W. Parcell, Winston-Salem, NC (US)

(72) Inventors: Gary Ortiz, Clemmons, NC (US); Jason W. Parcell, Winston-Salem, NC (US)

(73) Assignee: Hayward Industries, Inc., Elizabeth, NJ (US)

( * ) Notice: Subject to any disclaimer, the term of this patent is extended or adjusted under 35 U.S.C. 154(b) by 0 days.

(21) Appl. No.: 13/632,300

(22) Filed: Oct. 1, 2012

(65) Prior Publication Data

US 2013/0028755 A1 Jan. 31, 2013

Related U.S. Application Data

(62) Division of application No. 12/269,981, filed on Nov. 13, 2008, now Pat. No. 8,297,920.

(51) Int. Cl.
*F04D 29/60* (2006.01)

(52) U.S. Cl.
USPC ..... 415/201

(58) Field of Classification Search
USPC ..... 415/201, 224, 225
See application file for complete search history.

(56) References Cited

U.S. PATENT DOCUMENTS

| | | | |
|---|---|---|---|
| D131,875 | S | 3/1942 | Houston |
| 3,468,260 | A | 9/1969 | Belden |
| 3,637,331 | A | 1/1972 | Smith et al. |
| 3,744,635 | A | 7/1973 | Horvath |
| 3,920,352 | A | 11/1975 | Speck et al. |
| 3,966,363 | A | 6/1976 | Rowley et al. |
| D255,480 | S | 6/1980 | Zieg |
| 4,242,064 | A | 12/1980 | Uncles |
| 4,269,557 | A | 5/1981 | Kidd |
| 4,287,067 | A | 9/1981 | Dyner |
| 4,353,846 | A | 10/1982 | Mehrens et al. |
| 4,473,470 | A | 9/1984 | Loutit |

(Continued)

FOREIGN PATENT DOCUMENTS

| | | | |
|---|---|---|---|
| EP | 0657602 | A1 | 6/1995 |
| EP | 1267085 | A2 | 12/2002 |

(Continued)

OTHER PUBLICATIONS

JP58211599A English Translation. The McElroy Translation Company. Washington D.C. Apr. 2013. 15 Pages.*

(Continued)

*Primary Examiner* — Richard Edgar
(74) *Attorney, Agent, or Firm* — McCarter & English, LLP

(57) ABSTRACT

Assemblies and methods for a booster pump used in a pool cleaning/filtration system are provided. An exemplary booster pump assembly is adapted to increase the water pressure of water flow for use in a pool cleaning system. The booster pump includes a front housing defining a substantially circular geometry having an inlet positioned substantially in the center of the front housing and extending axially outward with respect to the front housing. The booster pump also includes an outlet extending substantially laterally with respect to the front housing. The front housing and the rear housing form an enclosure for positioning of an impeller. The inlet and the outlet are each coupled to conduits having substantially similar flow diameters, and the water passing through the outlet at an increased water pressure is sufficient to make operable a positive pressure pool cleaner. Advantageous support structures and drain plug configurations are also provided.

4 Claims, 8 Drawing Sheets

(56) References Cited

U.S. PATENT DOCUMENTS

| | | | |
|---|---|---|---|
| 4,629,557 | A | 12/1986 | Tobias |
| 4,773,823 | A | 9/1988 | Pease |
| 4,783,260 | A | 11/1988 | Kurihara |
| D299,143 | S | 12/1988 | Hazlehurst |
| 4,871,303 | A | 10/1989 | Roesler |
| 4,898,513 | A | 2/1990 | Hon |
| 5,156,535 | A | 10/1992 | Budris et al. |
| 5,193,977 | A | 3/1993 | Dame |
| 5,255,398 | A | 10/1993 | Flynn et al. |
| 5,409,606 | A | 4/1995 | Spencer |
| 5,624,559 | A | 4/1997 | Levin et al. |
| 5,858,234 | A | 1/1999 | Sukun |
| 5,897,787 | A | 4/1999 | Keller |
| D419,567 | S | 1/2000 | Weiss |
| 6,041,453 | A | 3/2000 | Barrow et al. |
| D425,911 | S | 5/2000 | Fleischer et al. |
| 6,149,407 | A | 11/2000 | Laing |
| 6,287,466 | B1 | 9/2001 | Yassin |
| D450,106 | S | 11/2001 | Herr |
| D450,327 | S | 11/2001 | Mori et al. |
| 6,379,127 | B1 | 4/2002 | Andrews et al. |
| D466,522 | S | 12/2002 | Huang |
| 6,554,587 | B2 | 4/2003 | Paolini et al. |
| 6,623,245 | B2 | 9/2003 | Meza et al. |
| 6,659,717 | B1 | 12/2003 | Kao |
| 6,824,354 | B2 | 11/2004 | Laing |
| 6,866,774 | B1 | 3/2005 | Stephenson |
| D507,579 | S | 7/2005 | Rossman et al. |
| 6,939,463 | B2 | 9/2005 | Leaverton |
| 6,955,637 | B1 | 10/2005 | Montano et al. |
| 6,974,303 | B2 | 12/2005 | Wang |
| 7,001,159 | B2 | 2/2006 | Peterson, Jr. et al. |
| D517,570 | S | 3/2006 | Stiles, Jr. et al. |
| 7,063,791 | B2 | 6/2006 | Miner |
| D536,705 | S | 2/2007 | Griffin et al. |
| 7,223,337 | B1 | 5/2007 | Franzino et al. |
| D550,805 | S | 9/2007 | Hazlehurst |
| D551,256 | S | 9/2007 | Pecca et al. |
| D557,374 | S | 12/2007 | Pecca |
| D568,340 | S | 5/2008 | Stiles, Jr. et al. |
| D588,159 | S | 3/2009 | Griffin et al. |
| D590,842 | S | 4/2009 | Clark et al. |
| 7,531,092 | B2 | 5/2009 | Hazlehurst |
| 8,297,920 | B2 | 10/2012 | Ortiz et al. |
| 2001/0021613 | A1 | 9/2001 | Fadeley et al. |
| 2004/0091373 | A1 | 5/2004 | Terry et al. |
| 2005/0019154 | A1 | 1/2005 | Dial |
| 2005/0084401 | A1 | 4/2005 | Coray et al. |
| 2005/0100455 | A1 | 5/2005 | Tuddenham |
| 2005/0118039 | A1 | 6/2005 | Shorten et al. |
| 2005/0158194 | A1 | 7/2005 | Sloan et al. |
| 2005/0158195 | A1* | 7/2005 | Peterson et al. ..... 417/423.11 |
| 2006/0088423 | A1 | 4/2006 | Brunet et al. |
| 2007/0114162 | A1 | 5/2007 | Stiles et al. |
| 2007/0286723 | A1 | 12/2007 | Ihle et al. |
| 2008/0079259 | A1 | 4/2008 | Parcell |
| 2009/0136363 | A1 | 5/2009 | Stiles, Jr. et al. |
| 2009/0145498 | A1 | 6/2009 | Bowman et al. |

FOREIGN PATENT DOCUMENTS

| | | | |
|---|---|---|---|
| JP | 58211599 A | * | 12/1983 |
| JP | 06341398 | | 12/1994 |
| WO | WO 00/68575 | | 11/2000 |

OTHER PUBLICATIONS

U.S. Appl. No. 60/732,439, Title: Strainer Basket, filed Oct. 31, 2005, Inventor: Jeffrey Pecca (24 pages).

Sta-Rite® Owner's Manual for the Max-E-Glass II™ and Dura-Glass II™ Centrifugal Pumps with Integral Trap (2003) (19 pages).

Sta-Rite® Basket C8-58P (2003) (Perspective and Six Orthogonal View Photographs) (7 pages).

Pages from various Internet sources printed on Oct. 25, 2005 (17 pages).

Textron, Inc., Various Textron Busings Printouts from http://www.avdel.textron.com (at least as early as Jan. 2006) (5 pages).

Hayward Buyer's Guide and Parts Price List, effective Dec. 29, 2003 (4 pages).

Office Action mailed Oct. 11, 2011 from parent application, U.S. Appl. No. 12/269,981, now U.S. Patent No. 8,297,920 (8 pages).

Office Action mailed Jan. 18, 2012 from parent application, U.S. Appl. No. 12/269,981, now U.S. Patent No. 8,297,920 (18 pages).

Notice of Allowance mailed Jun. 29, 2012 from parent application, U.S. Appl. No. 12/269,981, now U.S. Patent No. 8,297,920 (9 pages).

* cited by examiner

BOOSTER PUMP SYSTEM FOR POOL APPLICATIONS

CROSS REFERENCE TO RELATED APPLICATION

The present application is a divisional application of, and claims the benefit of priority to, U.S. patent application Ser. No. 12/269,981, filed Nov. 13, 2008, the disclosure of which is expressly incorporated herein by reference in its entirety for all purposes.

BACKGROUND

1. Technical Field

The present disclosure relates generally to the field of swimming pools and related pool cleaner systems. More particularly, the present disclosure relates to an advantageous booster pump assembly for use with fluid supply lines connected to pool cleaners and the associated booster pump systems.

2. Background Art

Motor-driven pumps for use with swimming pools and/or spas are generally known in the art, wherein the pump is adapted to deliver a flow of water under pressure to one or more pool equipment items prior to recirculation of the water to the pool or spa. For example, modern swimming pool and/or spa facilities typically include a filtration unit containing an appropriate filter media for collecting and removing solid debris, such as fine grit, silt, twigs, leaves, insects, and other particulate matter, from water circulated therethrough. A motor-driven pump draws water from the pool and/or spa for delivery to and through the filtration unit, and for subsequent return circulation to the pool and/or spa. Such pumps are typically operated on a regular schedule to maintain the water in a desired state of cleanliness and clarity. The pump may also circulate the water through additional equipment components or units, such as heating and chemical treatment assemblies and the like.

In some installations, the water can be circulated from the filtration unit to and through a hydraulically driven pool cleaner device mounted in the pool or spa and adapted for dislodging and collecting debris and particulate which has settled or otherwise accumulated on submerged surfaces. Exemplary hydraulically driven pool cleaner devices are shown and described in U.S. Pat. Nos. 5,863,425; 4,558,479; 4,589,986; and 3,822,754. In some pool equipment configurations and systems, a secondary or so-called booster pump is provided for boosting the pressure of water supplied to the pool cleaner device for ensuring effective operation thereof.

A swimming pool normally includes a water filtration system for removing dirt and debris from the pool water. Such filtration systems typically include a circulation pump which is installed/position outside the swimming pool and a piping system for coupling the circulation pump to the swimming pool. The circulation pump draws water from the swimming pool for delivery through the piping system to a filter unit.

Conventional water filtration systems exhibit certain limitations with respect to silt and debris removal. Such limitations generally relate to size, weight and other debris characteristics. To address the foregoing limitations, automatic swimming pool cleaners for cleaning the floor and sidewalls of a swimming pool have been developed and are known. Pool cleaners in the pool cleaning market generally fall into one of four categories: pressure or return side cleaners; suction cleaners; electric cleaners and in-floor cleaners. Of these four cleaner categories, only the pressure/return-side cleaner generally implicates incorporation of a booster pump into the pool system.

Generally, "pressure" or return-side cleaners use pressurized water from a pump delivered to the cleaner to sweep and collect debris into a bag carried by the cleaner. Pressurized cleaners can be grouped into at least two sub-categories—those requiring a booster pump and those that do not. In typical pool installations, booster pumps can be used in conjunction with a skimmer pump and/or a circulation pump associated with a pool's filtration system to provide pressurized water to a cleaner at a rate sufficient to operate the cleaner effectively.

Current pool cleaning systems that include booster pumps are characterized by a booster pump that includes inlet and outlet fittings that are ¾ inch in diameter. Fittings associated with pool cleaners, particularly pressure or return-side cleaners, feature fittings that are 1½ inches in diameter. To connect the booster pump to the cleaner, tubing and/or hoses are typically employed. In conventional pool cleaning installations that include a booster pump, tube(s) and/or hose(s) of 1½ inch diameter are typically connected to the cleaner and extend to the booster pump. However, to mate the 1½ inch diameter tube/hose with the ¾ inch diameter booster pump fitting, an appropriate diameter reduction is required. Similarly, the water fed from the pool to the booster pump typically flows through larger diameter tubing/hoses, e.g., tubes/hoses of 1½ inch diameter. As a result, a throttling of the water flow is required to feed such flow into the ¾ inch booster pump inlet.

While conventional installations are effective to route water from the pool to the booster pump and from the booster pump to the pool cleaner, several issues have been observed with current system pool assemblies and systems. As water is fed to and from the booster pump undesirable noise levels have been encountered. Contributions to undesirable noise levels associated with conventional booster pump operation may derive from several aspects of conventional assemblies. For example, noise may be caused by throttling of water flow to a lesser diameter flow path as it enters the booster pump, i.e., from a "bottle neck" effect associated with the booster pump drawing a high volume flow through a reduced diameter inlet (as compared to the tube/hose routing the flow thereto). In addition, pressure effects as the booster pump steps up the water pressure and feeds the pressurized water into a region of diameter expansion. Beyond noise issues, the step-down and step-up in flow diameter undesirably increases strain on the motor.

Accordingly, a need exists for improved pool cleaning/circulation systems that include a booster pump exhibiting reduced noise levels and experiencing reduced operational strain on the motor associated with the booster pump. A need also exists for a more efficient pool cleaning and/or circulation system utilizing a booster pump. These and other needs are met, and the disadvantages and/or limitations of prior art systems are addressed and/or overcome, by the assemblies and methods of the present disclosure.

SUMMARY

The present disclosure is directed to effective assemblies and methods that include, inter alia, a booster pump for use in a pool cleaning/filtration system. An exemplary booster pump assembly associated with the present disclosure is adapted to increase the water pressure of water flow for use in the pool cleaning/filtration system. According to exemplary embodiments of the present disclosure, the booster pump includes:

(a) a front housing defining a substantially circular geometry having an inlet positioned substantially in the center of the front housing extending axially outward with respect to the front housing and an outlet extending substantially laterally with respect to the front housing; (b) a rear housing forming an enclosure with the front housing; and (c) a motor positioned rearwardly with respect to the rear housing. The inlet is adapted to allow water to flow into the enclosure formed by the front housing and the rear housing, and the outlet is adapted to allow water to exit the enclosure formed by the front housing and the rear housing.

The motor drives an internal impeller system positioned within the enclosure formed by the front housing and the rear housing. The impeller system is adapted to increase water pressure of the water flowing through the enclosure and exiting through the outlet. The inlet and outlet are each coupled to a conduit system, e.g., tubing, hoses or the like, having substantially similar flow diameters as compared to the respective inlet and outlet, and the water passing through the outlet at an increased water pressure is sufficient to make operable a positive pressure pool cleaner. In an exemplary embodiment, the inlet, the outlet and the coupled conduit systems each define a diameter of about 1½ inches. The conduit system is typically flexible in design and may be selected from among conventional pipes, hoses and combinations thereof.

Turning to additional advantageous aspects of the disclosed booster pump system, in an exemplary embodiment thereof, the rear housing includes a drain plug that extends substantially laterally downward. The drain plug is adapted to be removable to allow draining of fluid accumulated within the enclosure formed by the front housing and the rear housing. Drain plug positioning according to the present disclosure enhances operation and use of the disclosed booster pump and overall pool infrastructure, facilitating access and drainage operations, as desired.

In a further exemplary embodiment of the present disclosure, the front housing is adjustably rotatable to allow a plurality of peripheral orientations of the outlet with respect to the inlet. Typically, the rear housing and the drain plug remain substantially stationary regardless of the front housing rotational orientation. In an exemplary embodiment, the motor is mounted with respect to the rear housing by a square flange to provide additional structural support to the rear housing and front housing enclosure. The square flange is typically detachably mounted with respect to the rear housing by one or more mounting members, e.g., screw(s), bolt(s) or the like.

In further exemplary embodiments, a booster pump assembly according to the present disclosure may include a support structure adapted to provide structural support to the enclosure and the motor. Exemplary support structures include: (i) a front side support member extending upwardly to provide support to at least the rear housing; and (ii) a rear side support member extending upwardly to provide support to at least the motor. In an exemplary embodiment, the rear housing includes a pair of spaced apart bosses extending laterally downward, the bosses configured and dimensioned to cooperate with a pair of apertures defined on the support structure. The apertures are adapted to receive the bosses and to thereby provide structural support to at least the rear housing.

In a further exemplary embodiment, the coupling of the inlet and/or the outlet to the conduit system is facilitated by union connector(s). An exemplary booster pump according to the present disclosure may include a handle having a front portion extending upwardly from the rear housing and a rear portion extending upwardly from the motor. The handle is adapted to allow for convenient manual maneuvering of the booster pump.

The present disclosure further provides an exemplary method for increasing the pressure of water flow through a pool cleaning system, including the steps of: (a) providing water flow through a first conduit system to an inlet positioned substantially in the center of a substantially circular front housing of a booster pump; (b) circulating the water through an internal impeller system positioned within an enclosure formed by the front housing and a rear housing of the booster pump, the impeller system being driven by a motor that is positioned substantially rearwardly with respect to the rear housing; and (c) delivering the water flow at an increased pressure through an outlet extending substantially laterally with respect to the front housing to a second conduit system adapted to define a flow path for the pressurized water to a positive pressure pool cleaner. Typically, the first conduit system, the second conduit system, the inlet and the outlet all define substantially the same flow diameter. In an exemplary method, the first conduit system, the second conduit system, the inlet and the outlet each define a flow diameter of about 1½ inches.

Additional features, functions and benefits of the disclosed assemblies and methods will be apparent from the description which follows, particularly when read in conjunction with the appended figures.

BRIEF DESCRIPTION OF THE DRAWINGS

To assist those of ordinary skill in the art in making and using the disclosed assemblies and methods, reference is made to the appended figures, wherein.

DESCRIPTION OF EXEMPLARY EMBODIMENT(S)

Figure 1:
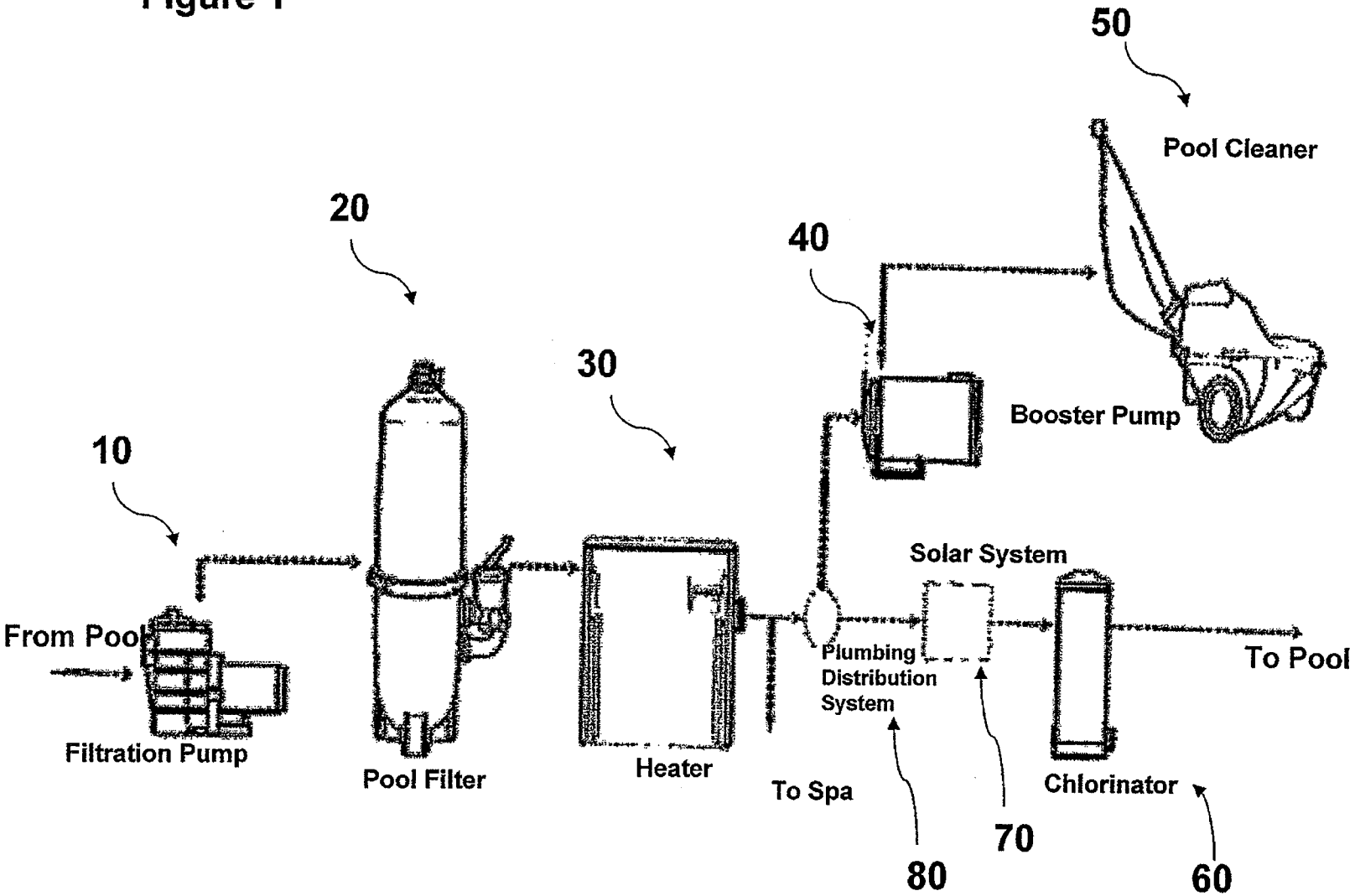
FIG. 1 is a schematic flowchart illustrating an exemplary pool cleaning system that includes, inter alia, a booster pump according to the present disclosure.

The present disclosure relates to pool circulation and/or cleaning systems and methods utilizing a more efficient and effective booster pump assembly. FIG. 1 provides a schematic diagram/flowchart that illustrates exemplary water flow relative to a pool and, in particular, water flow as it passes from a pool through an exemplary pool cleaning system associated with the present disclosure. Referring to FIG. 1, an exemplary pool cleaning system includes at least one filtration pump 10, at least one pool filter 20, a heater 30, a booster pump 40, a pool cleaner 50 and a chlorinator 60. Filtration pump 10 can also be referred to as a circulation pump and, thus, it is noted that these terms can be used interchangeably. Typically, filtration pump 10 is coupled to a conduit system, e.g., a hose and/or tubing system (not shown but represented by dashed lines indicating the flow of pool water through the system), adapted to guide water from the pool through the cleaning system.

The conduit system typically constitutes a series of hoses, pipes, tubing and combinations thereof. Pump 10 is operable to draw water from the pool through at least one hose and/or pipe associated with the conduit system so as to pump from the pool and deliver the pool water through the cleaning system. During system operation, filtration pump 10 pumps pool water from the pool to pool filter 20. An exemplary pool filter 20 is adapted to remove undesirable content from the pool water and then deliver the "filtered" water to heater 30 for effectuating temperature change of the "filtered" pool water.

Typically, pool water flows from heater 30 through a plumbing distribution system or manifold 80 that is adapted to split the water flow into multiple streams. When desired, a portion of the pool water exiting heater 30 is directed to booster pump 40. The remaining portion of the stream can be directed to one or more alternative locations. In an exemplary embodiment (such as the system shown in FIG. 1), a portion of the flow is directed to a spa and a different portion of the stream is directed to a chlorinator 60. Chlorinator 60 is adapted to chlorinate the pool water to a desired chlorine concentration before being delivered back to the pool. In an exemplary embodiment, at least a portion of the pool water passes through a solar heating system 70 as shown in FIG. 1. Solar system 70 is adapted to provide additional pool water heating to raise the pool water to a desired temperature. It is understood that inclusion of a solar system 70 as well as plumbing distribution systems as described herein are optional depending on the cleaning system design and operational preferences. It is also to be understood that additional plumbing distribution systems may be located in an alternative and/or additional locations, e.g., between pool filter 20 and heater 30, with pool water being directed around heater 30 to booster pump 40. The present disclosure is not limited by or to specific plumbing layouts, as will be apparent to persons skilled in the art from the disclosure hereof.

Booster pump 40 is adapted to receive water through an inlet and deliver the water at a raised water pressure through an outlet. The pressurized water is then delivered through a conduit system in fluid communication with the outlet of the booster pump, e.g., at least one hose/pipe/tube, to a pool cleaner 50. Booster pump 40 is typically selected and operated so as to increase the pressure of the pool water flow to effectively operate a positive pressure pool cleaner 50. Pool cleaner 50 can be any positive pressure pool cleaner adapted to clean the floor and/or walls associated with the pool, as are known in the art. Exemplary positive pool cleaners for use according to the present disclosure are commercially available from the assignee of the present application, Hayward Industries, Inc. (Elizabeth, N.J.), under the tradenames PHANTOM and VIPER.

Figure 2:
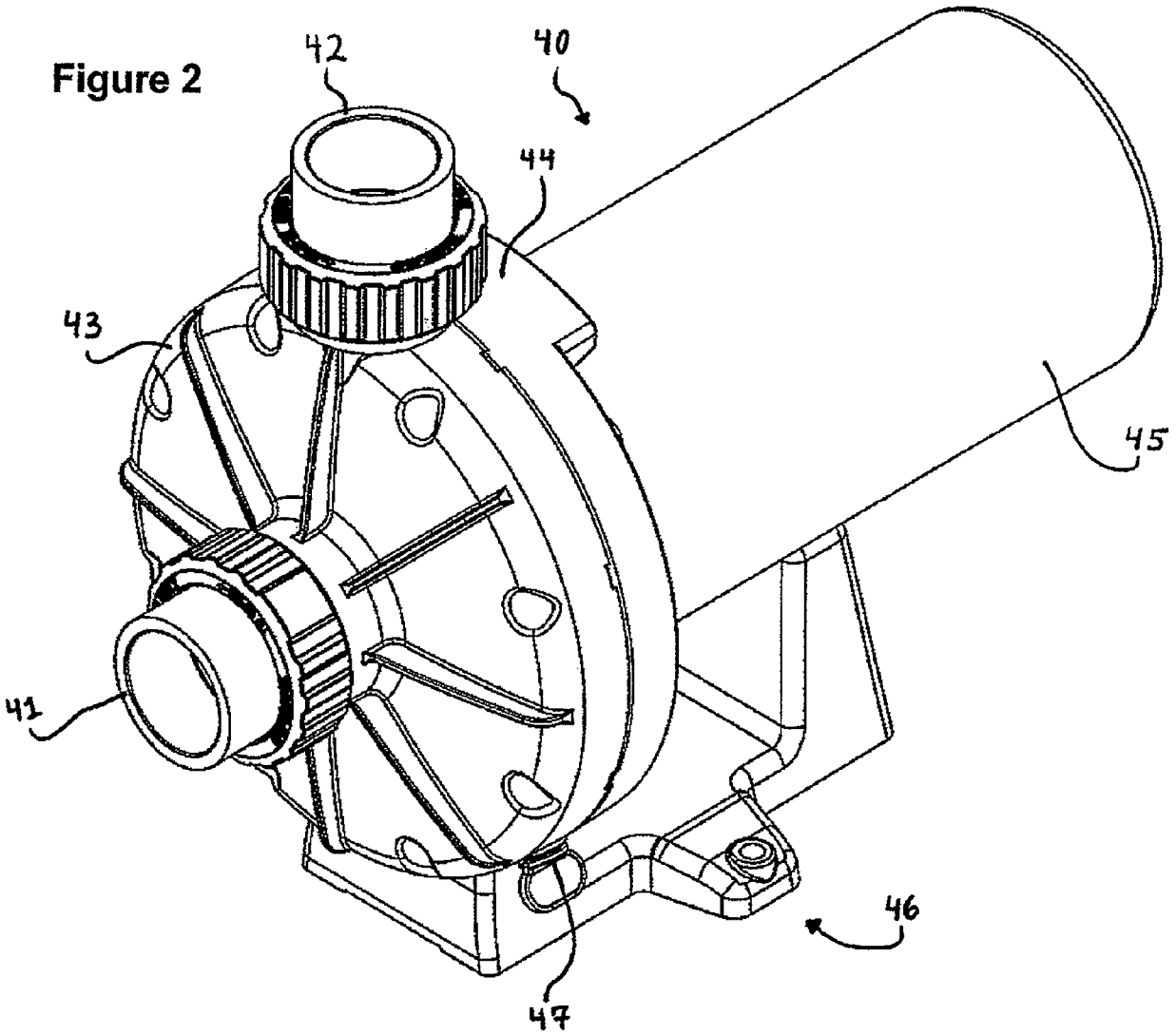
FIG. 2 is a front side perspective view of an exemplary booster pump associated with the present disclosure.

FIG. 2 illustrates a perspective view of an exemplary booster pump 40 associated with the present disclosure. Booster pump 40 includes a substantially circular front housing 43 defining an inlet 41. Typically, inlet 41 is positioned substantially in the center of front housing 43 and extends axially outward with respect to front housing 43. Inlet 41 is adapted to cooperate with a conduit, e.g., a standard hose, tube and/or pipe, that feeds pool water to booster pump 40. The conduit (not shown in FIG. 2) and inlet 41 advantageously define substantially equal internal flow diameters. Thus, in an exemplary embodiment of the present disclosure, both the conduit and inlet 41 define an internal flow diameter of about 1½ inches. Coupling of the conduit and inlet 41 may be achieved by any standard coupling technique, as are known in the art.

Booster pump 40 further includes a rear housing 44 adapted to form an enclosure with front housing 43. The enclosure formed by front housing 43 and rear housing 44 is adapted to enclose an impeller system (not shown). The impeller system is rotatably mounted with respect to the enclosure and is adapted to increase the pressure of water flow that enters the enclosure through inlet 41 of booster pump 40. The internal impeller system is driven by a motor 45 that is adapted to effectuate rotation and operation of the impeller system.

Booster pump 40 further defines an outlet 42 that is adapted to be coupled to a conduit for fluid communication of water from the enclosure, e.g., to a downstream pool cleaning system. Typically, outlet 42 extends substantially laterally with respect to front housing 43 and rear housing 44. In an exemplary embodiment, outlet 42 extends upwardly along a substantially vertical axis with respect to booster pump 40. Outlet 42 is coupled to a conduit, e.g., a hose, tube or a pipe, that exhibits a substantially equivalent internal flow diameter. Thus, in an exemplary embodiment of the present disclosure, both outlet 43 and the conduit to which it is in fluid communication define an internal flow diameter of about 1½.

Figure 3:
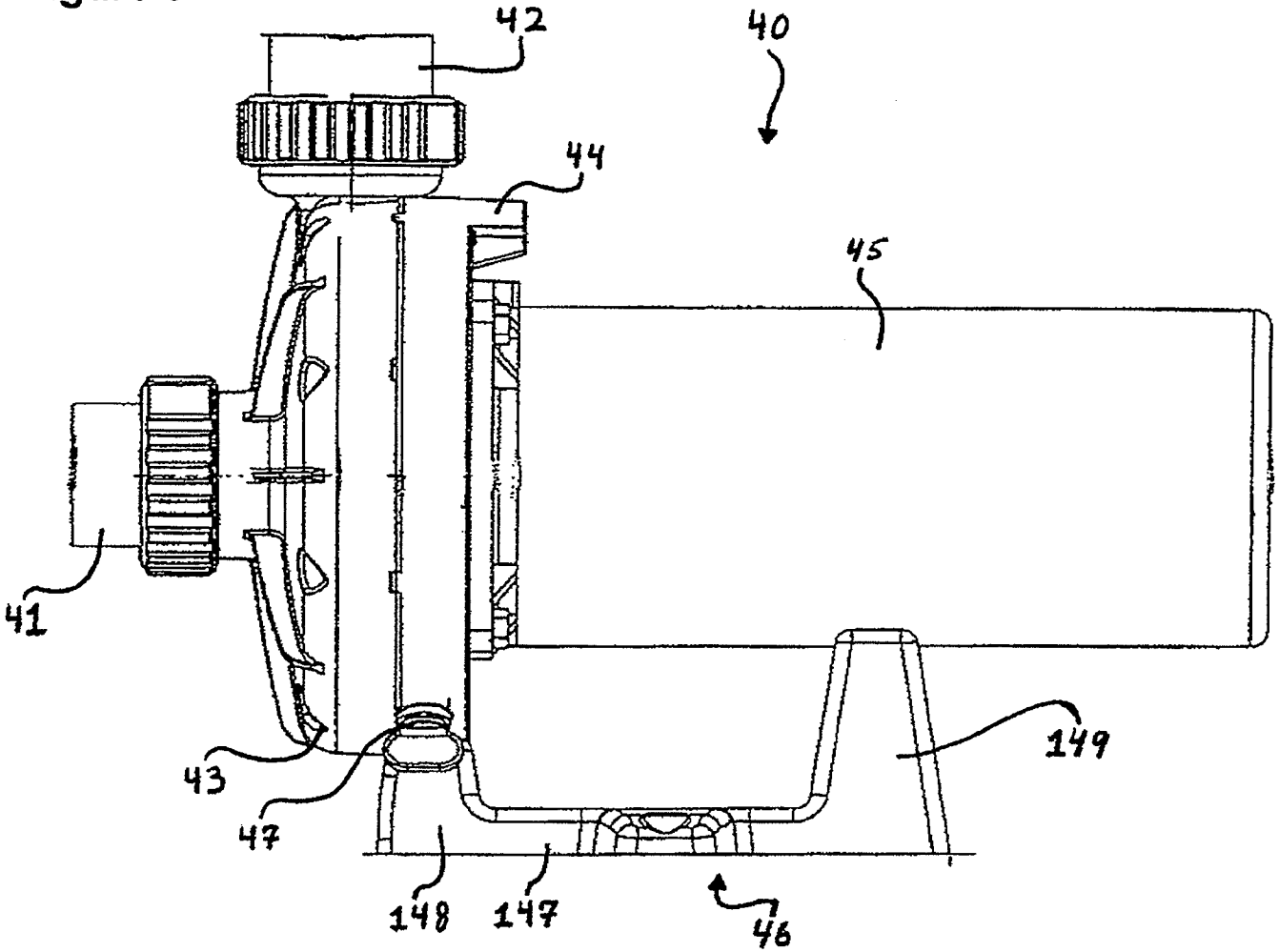
FIG. 3 is a side view of the exemplary booster pump shown in FIG. 2.

FIG. 3 is a side view of booster pump 40. In an exemplary embodiment, booster pump 40 is adapted to securely rest upon a support structure 46. Support structure 46 can also be referred to as a stand or a pump stand. Support structure 46 typically includes a base member 147, a front housing support member 148 and a rear side motor support member 149. Base member 147 generally defines a substantially flat lower face that extends parallel with the axial length of booster pump 40. Support structure 46 is adapted to support the weight of booster pump 40 and to secure booster pump 40 in a substantially fixed position during pump operation. Through the advantageous design of support structure 46, movement of booster pump 40 during pump operation that may result from motor activity and/or water flow is substantially reduced/prevented.

Member 148 extends upwardly with respect to a front portion of base member 147 and cooperates with the rear housing 44 associated with booster pump 40 to engage and secure at least rear housing 44. In an exemplary embodiment, support structure 46 further supports the internal impeller system, and front housing 43. Member 149 extends upwardly with respect to a rear portion of base member 147 and supports motor 45 associated with booster pump 40 to secure at least motor 45. Both members 148 and 149 advantageously define arcuate surfaces for engagement with the undersigned of booster pump 40. The radius of the foregoing arcuate surfaces is generally selected so as to substantially conform to the geometry of the cooperative booster pump components.

In an exemplary embodiment, booster pump 40 includes a drain plug 47 as shown in FIG. 2 and FIG. 3. Drain plug 47 extends substantially laterally downward with respect to rear housing 44 and cooperates with an aperture (typically threaded aperture) defined in rear housing 44. Drain plug 47 is detachably positioned along the periphery of rear housing 44. Drain plug 47 is adapted to be removed to allow for draining of excess liquid that may accumulate within booster pump 40.

In an exemplary embodiment, front housing 43 is adjustably rotatable in a substantially circular direction, i.e., clockwise or counterclockwise, to allow more efficient coupling to associated conduit systems, e.g., to facilitate fluid communication with a cleaning system or the like. For example, front housing 43 can be rotated 90 degrees such that outlet 42 extends substantially perpendicular to a vertical axis position, i.e., so as to be oriented at a 3 o'clock or 9 o'clock position. Providing a front housing 43 having a degree of rotational freedom allows more flexibility in coupling the booster pump 40 to desired fluid conduits, e.g., tubing and/or piping, without disturbing the relative positioning of the other features associated with booster pump 40, e.g., motor 45, rear housing 44, drain plug 47 and the internal impeller system. Moreover, booster pump 40 can remain supported upon support structure 46 without compromising the balance and support strength of the support structure or the booster pump. Typically rear housing 44 is coupled to motor 45 and is generally fixed in a non-rotatable position. This allows for a further advantage of drain plug 47 remaining in a substantially downward position, regardless of the relative orientation of front housing 43.

Figure 4:
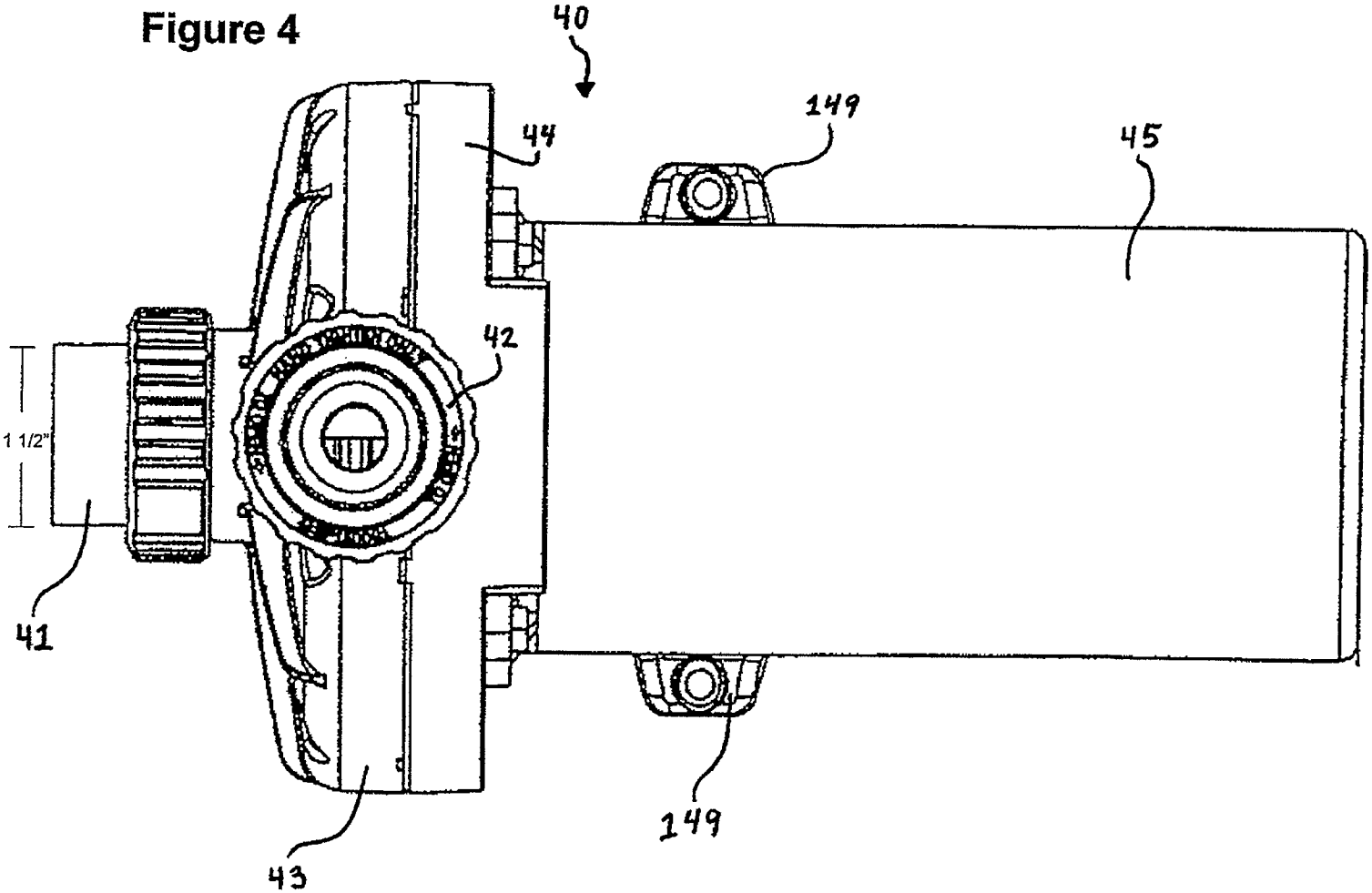
FIG. 4 is a top view of the exemplary booster pump shown in FIGS. 2 and 3.
Figure 5:
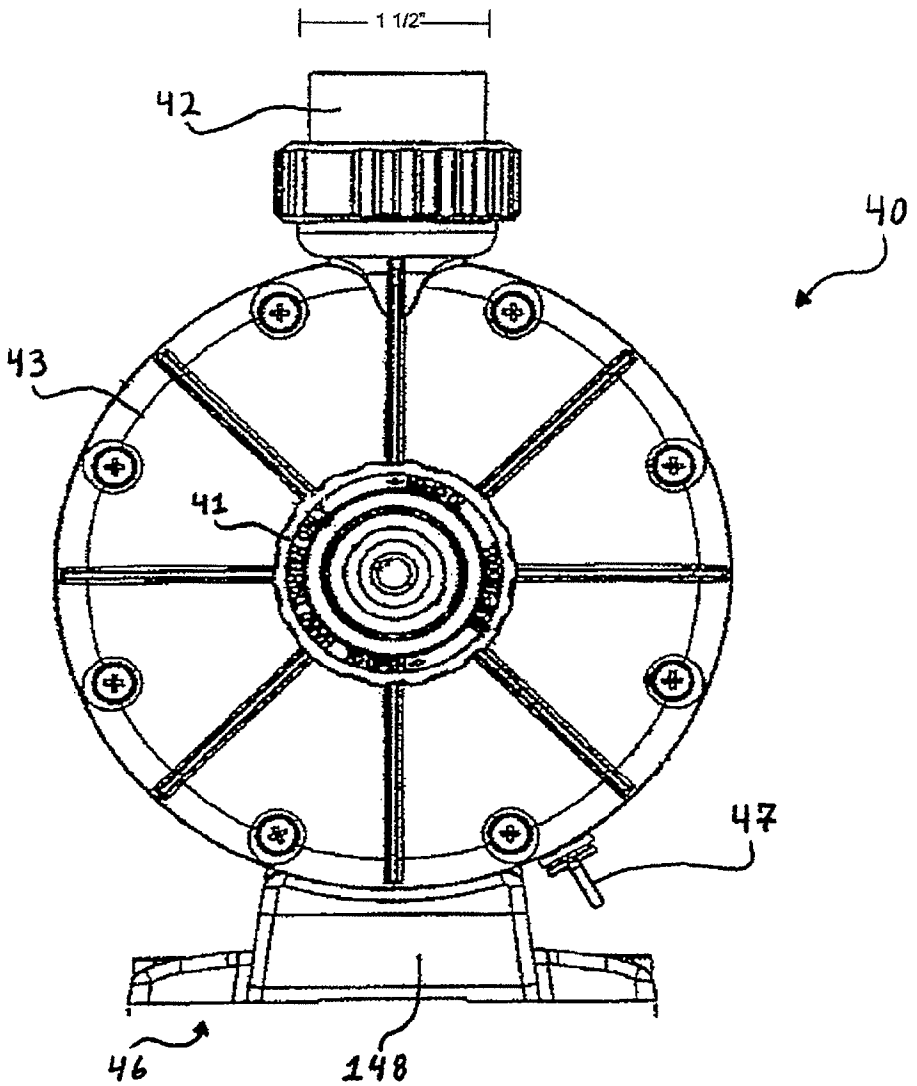
FIG. 5 is a front view of the exemplary booster pump shown in FIGS. 2-4.

FIG. 4 illustrates a top view and FIG. 5 illustrates a front view of booster pump 40. As shown in FIG. 4, booster pump 40 includes: (i) an inlet 41 that is positioned substantially in the center of front housing 43 and that extends axially outward with respect to front housing 43; and (ii) an outlet 42 that extends laterally with respect to front housing 43. As noted above, front housing 43 may be adapted to rotate with respect to rear housing 44. Such rotation allows for outlet 42 to extend laterally with respect to front housing 43 at a plurality of relative positions. Front housing 43 and rear housing 44 each define a substantially circular geometry. Since inlet 41 is positioned substantially in the center of front housing 43, rotating front housing 43 does not compromise the central positioning of inlet 41. Maintaining the central positioning of inlet 41 regardless of the relative peripheral positioning of outlet 42 is advantageous because impeller operation relies on central flow introduction to effect a pressure increase through the centrifugal impeller operation. Outlet 42 is adapted to allow for pressurized water flow to exit booster pump 40 and be delivered through a fluid conduit, e.g., a tube, hose and/or pipe, to other components of the pool cleaning system, as shown in FIG. 1.

Through the advantageous mating of inlet/conduit and outlet/conduit flow diameters, the present disclosure overcomes significant issues encountered in prior art systems that are intended to provide pressurized fluid flow to a positive pressure pool cleaner. Although the present disclosure contemplates inlet/conduit and outlet/conduit flow diameters of 1½, systems and methods of the present disclosure are not limited by or to such implementations. Rather, the matched diameter at the inlet and outlet of the booster pump may be sized to meet operational needs. The matched inlet and outlet diameters advantageously reduce noise associated with booster pump operation and allow for more efficient operation thereof. In addition, coupling at the inlet and outlet of the booster pump is generally streamlined by the matching of flow diameters, as disclosed herein. In addition, motor/booster pump operation is more controlled and effective, thereby potentially reducing energy usage and mechanical strain.

Figure 6:
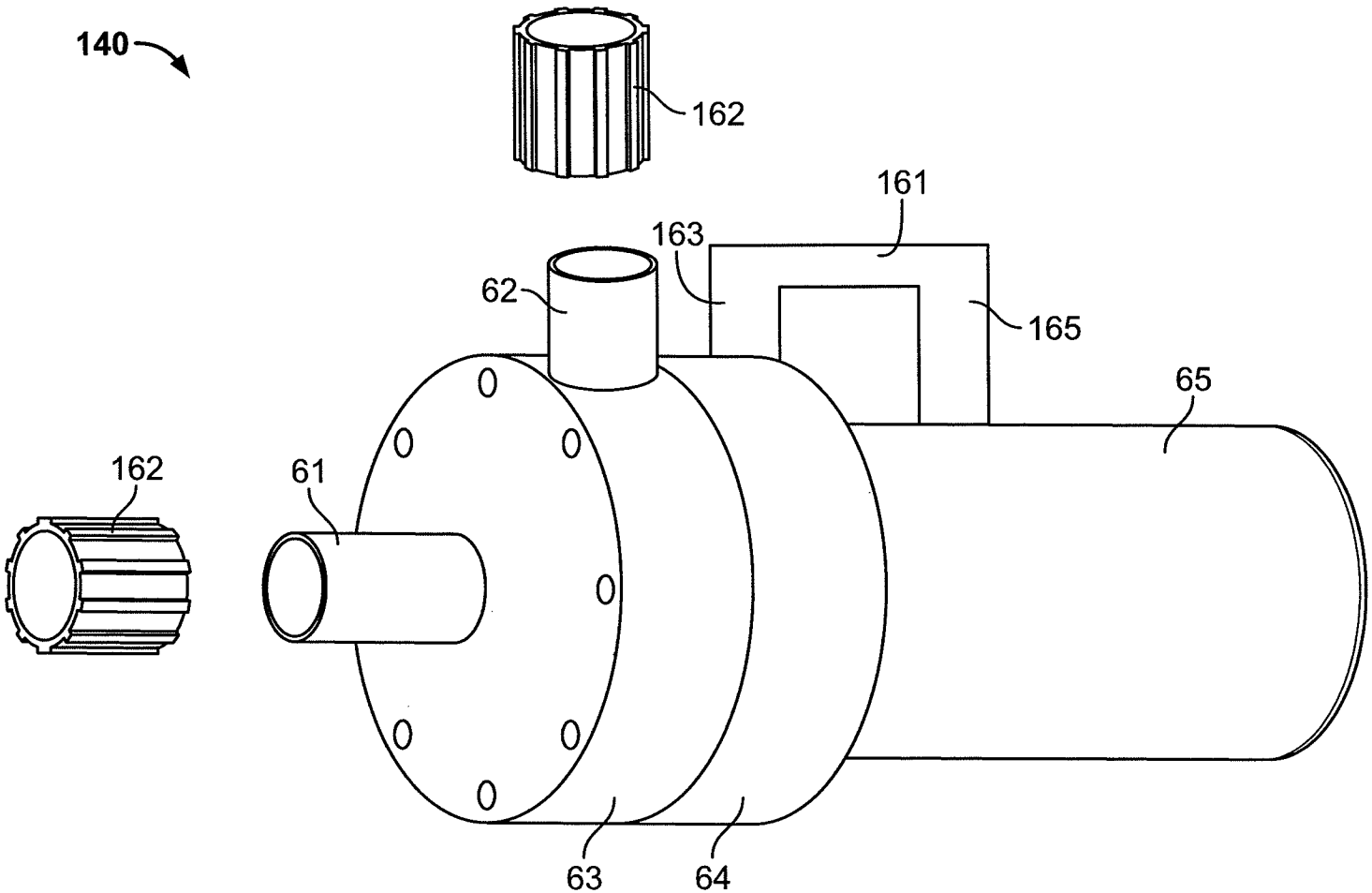
FIG. 6 is a schematic illustrating an exemplary booster pump that is adapted to engage union connectors according to the present disclosure.

FIG. 6 is a side view of an exemplary booster pump 140 associated with the present disclosure. Booster pump 140 is similar to previously described exemplary booster pump 40 and includes a substantially circular front housing 63 defining an inlet 61 positioned in the center of front housing 63 that extends axially outward with respect thereto. Front housing 63 further defines an outlet 62 extending substantially laterally with respect to front housing 63. Booster pump 140 further includes a rear housing 64 forming an enclosure with front housing 63 that is adapted to surround/enclose an internal impeller (not shown). Operation of the impeller is effective to increase the pressure of the water exiting the booster pump through outlet 62. The impeller is driven by a motor 65 that extends rearwardly with respect to rear housing 64. Booster pump 140 further includes a handle 161 that is secured with respect to an upper portion thereof. More particularly, handle 161 includes a front portion 163 that is mounted with respect to and extends substantially upward with respect to rear housing 64, and a rear portion 165 that is mounted with respect to and extends upward with respect to motor 65. Handle member 161 allows for convenient manual maneuvering of booster pump 140.

In an exemplary embodiment, water flows from a flow conduit into booster pump 140 through inlet 61 and exits the booster pump through outlet 62 into further conduit that feeds the flow downstream at elevated pressure, e.g., to a positive pressure cleaner. In an exemplary embodiment, union connectors 162 are utilized in order to facilitate cooperation between a conduit and the inlet and/or outlet associated with the booster pump. Union connectors 162 are adapted to provide secure fitting between the conduit, e.g., a hose, tube and/or pipe, and the inlet and/or outlet of the booster pump. Union connector 162 generally includes threaded portions that are adapted to cooperate with threaded portions of the conduit and inlet/outlet, thereby creating a seal between the conduit and the inlet and/or outlet.

Figure 7:
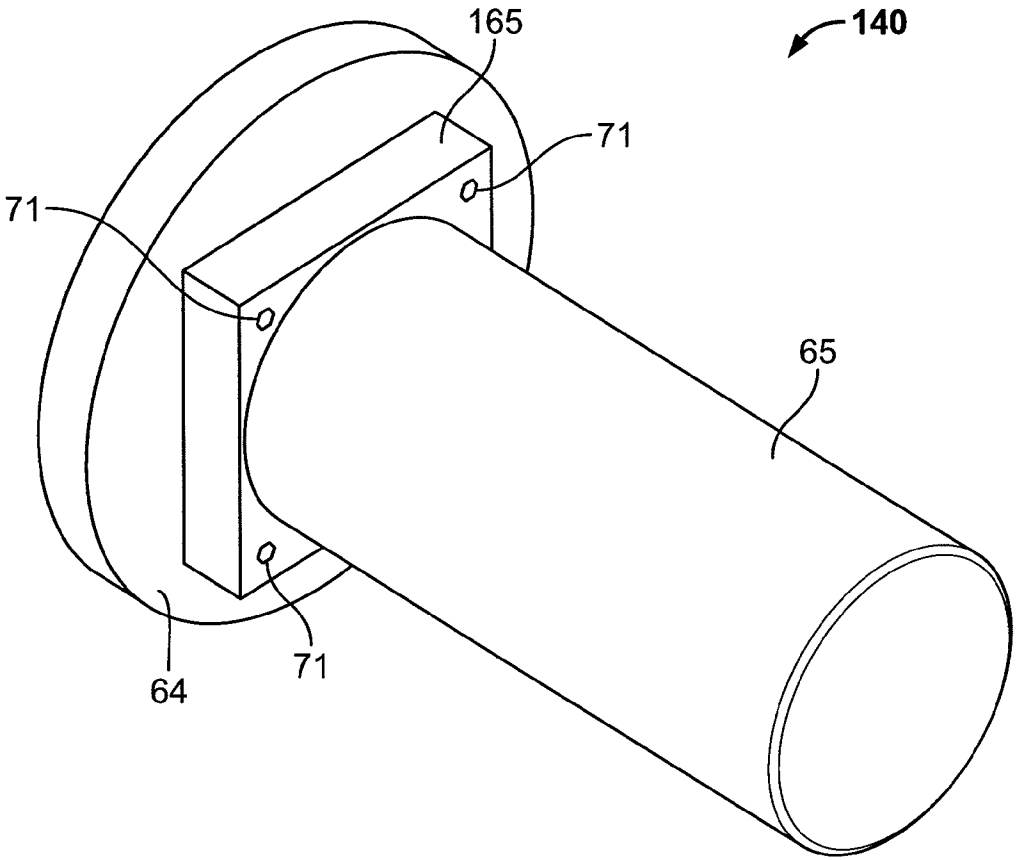
FIG. 7 is a rear perspective view of an exemplary booster pump of the present disclosure.

FIG. 7 is a schematic illustrating a rear side of exemplary booster pump 140 according to the present disclosure. Booster pump 140 includes a motor 65 that extends rearwardly relative to rear housing 64. In an exemplary embodiment, motor 65 is mounted with respect to rear housing 64 by a square flange 165 which is mounted with respect to rear housing 64 by securing members 71. Securing members 71 are typically screws and/or bolts. Square flange 165 provides additional structural support to rear housing 64, front housing 63 and the internal impeller.

Figure 8:
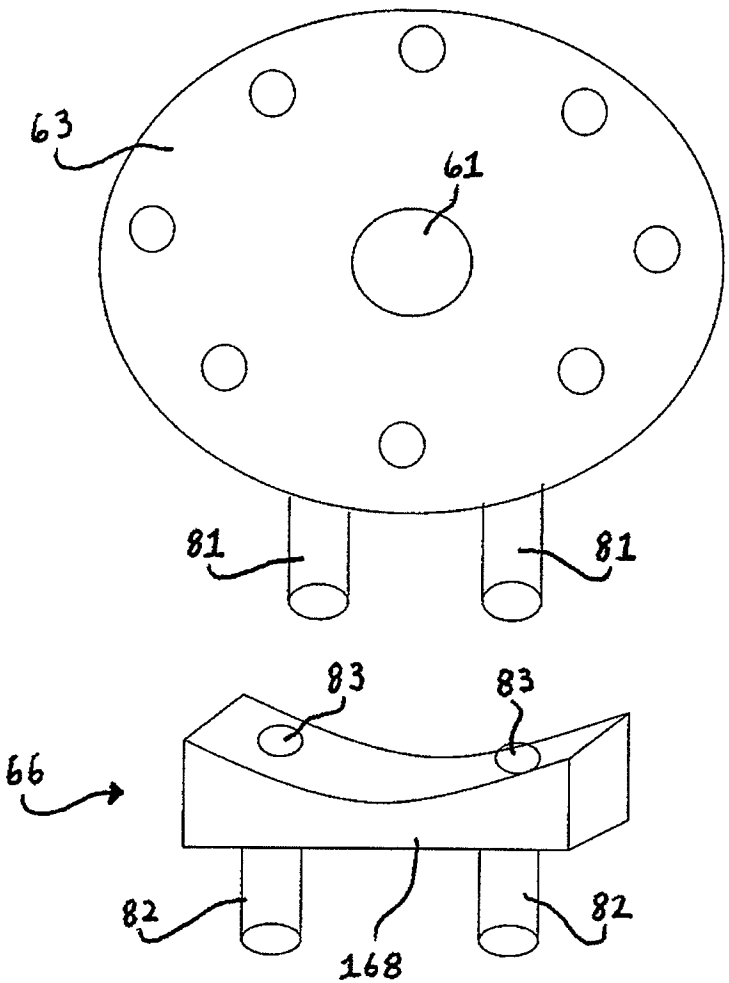
FIG. 8 is a front side schematic view of an exemplary booster pump with a support structure according to the present disclosure.

FIG. 8 is a schematic illustrating a front side of front housing 63 associated with exemplary booster pump 140. A pair of spaced apart supporting bosses 81 extend laterally and downward with respect to rear housing 64. Bosses 81 extend downward with respect to rear housing 64, regardless of the orientation of rotatable front housing 63. In an exemplary embodiment, booster pump 140 is supported by a support structure 66. Support structure 66 functions similarly to the support structure 46 previously described with reference to FIG. 3. Support structure 66 includes a front side support member 168 adapted to receive bosses 81 through a pair of receiving apertures 83. Support member 168 includes a pair of spaced apart support legs 82 adapted to securely stabilize at least the rear housing 64 associated with exemplary booster pump 140.

Although the present disclosure has been described with reference to exemplary embodiments and implementations thereof, the disclosed assemblies and methods are not limited to such exemplary embodiments/implementations. Rather, as will be readily apparent to persons skilled in the art from the description provided herein, the disclosed assemblies and methods are susceptible to modifications, alterations and enhancements without departing from the spirit or scope of the present disclosure. Accordingly, the present disclosure expressly encompasses such modification, alterations and enhancements within the scope hereof.

What is claimed:

1. A method for increasing the pressure of water flow through a pool cleaning system, comprising the steps of:

(a) providing water flow through a first conduit to an inlet positioned substantially in the center of a substantially circular front housing of a booster pump;

(b) delivering the water flow from the booster pump at an increased pressure through an outlet extending substantially laterally with respect to the front housing to a second conduit; and (c) draining the booster pump by removing a drain plug that extends substantially laterally downward from a rear housing of the booster pump;

wherein the first conduit, the second conduit, the inlet and the outlet all define substantially the same flow diameter.

2. A method according to claim 1, wherein the first conduit, the second conduit, the inlet and the outlet each define a flow diameter of about 1½ inches.

3. A method according to claim 1 wherein the first and second conduits are selected from the group consisting of pipes, hoses, tubes and combinations thereof.

4. A method according to claim 1, further comprising rotatably adjusting a front housing of the booster pump, while maintaining the drain plug in a fixed radial position.

* * * * *